US006109256A

United States Patent [19]

Sardi

[11] Patent Number: 6,109,256

[45] Date of Patent: Aug. 29, 2000

[54] HEATED CUSHION PARTICULARLY FOR USE IN STADIUMS AND SPORTS AND RECREATIONAL ACTIVITIES

[76] Inventor: Silvio Sardi, Via Donatori di Sangue 3, 26010 Ripalta Cremasca, Italy

[21] Appl. No.: 09/270,197

[22] Filed: Mar. 15, 1999

[30] Foreign Application Priority Data

Mar. 19, 1998 [IT] Italy ..... MI980189 U

[51] Int. Cl.[7] ..... A61F 7/00

[52] U.S. Cl. ..... 126/204; 126/205; 297/180.11; 297/180.15; 5/421

[58] Field of Search ..... 126/204–208, 126/263.01, 400; 5/421, 422, 468, 653, 654, 656; 297/180.11, 180.15

[56] References Cited

U.S. PATENT DOCUMENTS

| | | | |
|---|---|---|---|
| 697,279 | 4/1902 | Schmied | 297/180.15 |
| 4,060,276 | 11/1977 | Lindsay | 297/180.11 |
| 4,533,050 | 8/1985 | Bake . | |
| 4,604,987 | 8/1986 | Keltner . | |
| 4,949,887 | 8/1990 | Holmes . | |
| 5,527,091 | 6/1996 | Gruber . | |

FOREIGN PATENT DOCUMENTS

| | | | |
|---|---|---|---|
| 202645 | 10/1908 | Germany | 126/204 |
| 104052 | 6/1982 | Japan | 126/204 |
| 13969 | 8/1891 | United Kingdom | 126/205 |

*Primary Examiner*—James C. Yeung
*Attorney, Agent, or Firm*—Guido Modiano; Albert Josif

[57] ABSTRACT

A heated cushion particularly for stadiums and sports and recreational activities, comprising a body inside which a seat is formed for accommodating a container which is meant to be filled with hot water to diffuse heat from the inside of the cushion toward its outer surface.

9 Claims, 1 Drawing Sheet

HEATED CUSHION PARTICULARLY FOR USE IN STADIUMS AND SPORTS AND RECREATIONAL ACTIVITIES

BACKGROUND OF THE INVENTION

The present invention relates to a heated cushion particularly for use in stadiums and sports and recreational activities in general.

It is known that in open spaces such as stadiums and spaces in general in which people are forced to sit for a long time in low-temperature conditions, the need is felt to keep one's body as warm as possible in order to prevent a spectator of a sports event or the like from losing, due to the penetrating cold, the pleasure of attending a given sports event or the like.

Currently commercially available cushions are meant exclusively to provide greater sitting comfort for the user but cannot cope with the unfavorable weather conditions that the user can encounter.

SUMMARY OF THE INVENTION

The aim of the present invention is to provide a heated cushion which allows to improve the sitting comfort of a user in unfavorable weather conditions.

Within the scope of this aim, an object of the present invention is to provide a heated cushion whose characteristics allow it to maintain, for a preset time, a temperature which is sufficient to ensure the comfort of the user.

Another object of the present invention is to provide a heated cushion which can be used easily by the user.

Another object of the present invention is to provide a heated cushion having a low cost.

This aim, these objects and others which will become apparent hereinafter are achieved by a heated cushion particularly for stadiums and sports and recreational activities, characterized in that it comprises a body inside which a seat is formed for accommodating a container meant to be filled with hot water to diffuse heat from the inside of the cushion toward its outer surface.

BRIEF DESCRIPTION OF THE DRAWINGS

Further characteristics and advantages of the present invention will become apparent from the following detailed description of an embodiment thereof, illustrated only by way of non-limitative example in the accompanying drawings, wherein.

DESCRIPTION OF THE PREFERRED EMBODIMENTS

Figure 1:
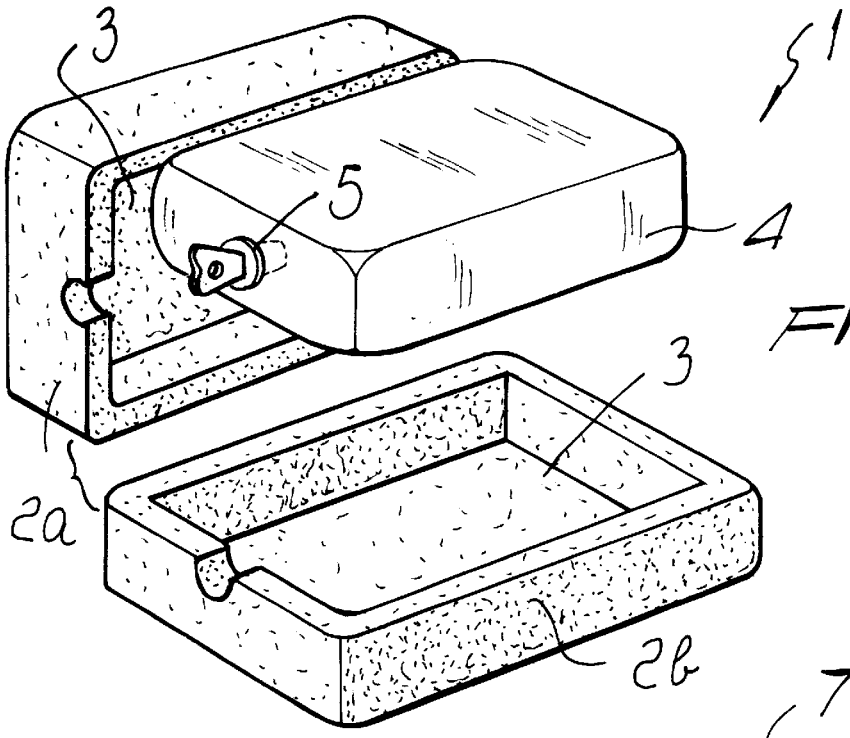
FIG. 1 is an exploded perspective view of the cushion according to the present invention.
Figure 2:
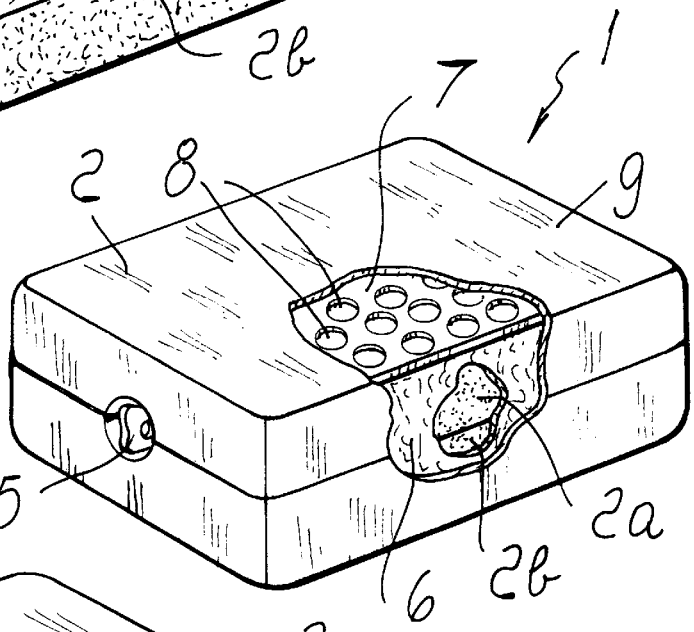
FIG. 2 is a partially cutout perspective view of the heated cushion according to the present invention.
Figure 3:
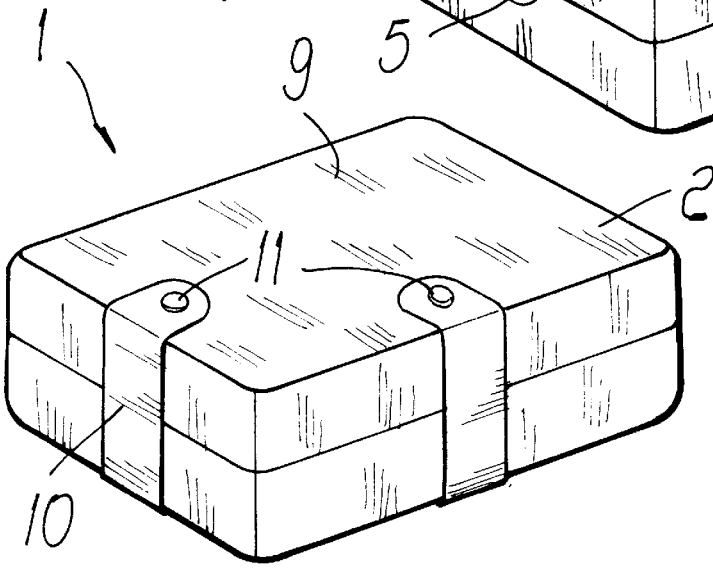
FIG. 3 is a perspective view of the cushion according to the invention.

With reference to the above figures, the heated cushion according to the present invention, generally designated by the reference numeral 1, comprises a body made of a water-repellent, thermally insulating material, preferably synthetic rubber, and of polyurethane foams, designated by the reference numeral 2, which is internally provided with a seat 3 in which a container 4 is inserted which is preferably made of plastics and is meant to be filled with hot water.

The container 4 is provided with a mouth 5 for filling it; said mouth fits in a suitable seat formed within the body 2.

The body 2 is in turn covered by a layer of material having a high thermal insulation level, such as for example felt, designated by the reference numeral 6; an additional layer of rubber 7 is deposited thereon and is suitably provided with a plurality of openings 8 adapted to allow the heat to flow out of the container 4.

The body 2 is conveniently made, for example, of two parts 2*a* and 2*b*, each of which contains a portion of the seat 3 which allows to accommodate the container 4.

The mouth 5 must be laterally accessible from the body 2 to allow to fill the container 4 accommodated therein.

Finally, a layer of fabric with various colorings is arranged around the upper rubber layer 7 so as to decorate and complete the cushion according to the invention.

In the figures, the layer of fabric is designated by the reference numeral 9.

Said layer of fabric 9 further acts as a hinge element between the part 2*a* and the part 2*b* of the body 2.

In order to keep the two parts mutually closed there are provided engagement straps 10 having press-studs 11.

The engagement strap 10 arranged, as shown in the figures, at the short side of the cushion according to the invention is actually meant to conceal the mouth 5 for filling the container 4.

In this manner, the container 4, filled with boiling water and inserted in the seat 3 formed in the body 2, allows said body to warm up and release heat by means of the plurality of openings 8 arranged on the side of the cushion on which the user is meant to sit.

Therefore, for example in the case of use in stadiums, or in any case of open-air activities in which the user must sit for a long time, the heat released by the container 4 allows to warm the user's body and therefore to extend the time for which he can remain at low temperatures.

The particular material of which the body 2 is made, i.e., water-repellent and thermally insulating material (synthetic rubber) and polyurethane foam with the addition of felt, allows to obtain a highly insulating body 2 so that the heat that arrives from the container 4 is not directly in contact with the user but is moderated by passing through said layers.

The body 2 is also made of a material which ensures softening at temperatures above 95° C., when water starts to boil.

Moreover, the body 2 must be made of a material which withstands a pressure of at least 150 kg, which is the maximum expected weight of a potential user.

It is of course possible to manufacture the body 2 using material which withstands higher pressures.

In practice it has been observed that the cushion according to the invention fully achieves the intended aim and objects, since it allows to heat the seating surface on which a user sits by virtue of the presence of the container that contains boiling water and is accommodated inside it.

In practice, the materials employed, so long as they are compatible with the specific use, as well as the dimensions, may be any according to requirements and to the state of the art.

The disclosures in Italian Utility Model Application No. MI98U000189 which this application claims priority are incorporated herein by reference.

What is claimed is:

1. A heated cushion particularly for stadiums and sports and recreational activities, comprising:

a body which is provided with an inner seat;

a container adapted to be filled with hot water and to be accommodated in said seat of the body; said container being adapted to diffuse heat from the inside of the body toward an outer surface of the body;

a layer of material providing high thermal insulation, arranged to cover said body; and a layer of rubber arranged over said layer of material providing high thermal insulation;

said layer of material providing high thermal insulation being felt.

2. The cushion according to claim 1, wherein said body is made of water-repellent and thermally insulating material.

3. The cushion according to claim 1, wherein said body is made of synthetic rubber and polyurethane foam.

4. The cushion according to claim 1, wherein said layer of rubber is provided with a plurality of openings for the release of the heat from the inside of said cushion toward the outside.

5. The cushion according to claim 1, wherein said body is made of two parts, each of which internally forms a portion of said seat for accommodating said container.

6. The cushion according to claim 1, wherein said container has a mouth to allow filling of the container, said mouth being provided with a screw-on plug.

7. The cushion according to claim 1, wherein said body has an additional layer of fabric arranged above said layer of rubber in order to provide an external covering of said cushion.

8. The cushion according to claim 5, comprising at least one strap which is meant to keep the two parts of said body closed.

9. The cushion according to claim 6, further comprising an additional strap adapted to conceal said filling mouth of the container.

* * * * *